United States Patent [19]

Ito

[11] 4,188,170

[45] Feb. 12, 1980

[54] DIAPHRAGM PUMP

[75] Inventor: Jinichi Ito, Tokyo, Japan

[73] Assignee: Yamada Yuki Seizo Co., Ltd., Tokyo, Japan

[21] Appl. No.: 896,151

[22] Filed: Apr. 13, 1978

[30] Foreign Application Priority Data

May 2, 1977 [JP] Japan ..... 52-50940
Jul. 28, 1977 [JP] Japan ..... 52-90560

[51] Int. Cl.[2] ..... F04B 9/10
[52] U.S. Cl. ..... 417/387; 417/308
[58] Field of Search ..... 417/385, 386, 387, 388; 60/543, 594, 537, 589

[56] References Cited

U.S. PATENT DOCUMENTS

| | | | |
|---|---|---|---|
| 1,961,602 | 6/1934 | Squires | 417/387 X |
| 2,620,629 | 12/1952 | Gauldie | 60/543 |
| 2,975,599 | 3/1961 | Bennett | 417/387 X |

FOREIGN PATENT DOCUMENTS

| | | | |
|---|---|---|---|
| 74725 | 10/1918 | Austria | 60/589 |
| 633708 | 12/1949 | United Kingdom | 417/385 |

*Primary Examiner*—Leonard E. Smith
*Attorney, Agent, or Firm*—Wenderoth, Lind & Ponack

[57] ABSTRACT

A diaphragm pump includes a pump chamber, a pressure fluid chamber, a diaphragm partitioning the interior of the pump into the pump chamber and the pressure fluid chamber, a cylinder communicating with the pressure fluid chamber, and a plunger reciprocable within the cylinder. The pressure fluid chamber or the cylinder communicates with a pressure fluid reservoir via a pressure regulating valve adapted to open when the pressure in the pressure fluid chamber is too high, and a valve adapted to open before the pressure in the pressure fluid chamber is too low, and to close when the pressure is restored to a given pressure level.

4 Claims, 7 Drawing Figures

DIAPHRAGM PUMP

BACKGROUND OF THE INVENTION

This invention relates to a diaphragm pump for delivering a pressure fluid to, for instance, a spray gun for spraying a pressure fluid or liquid, such as a paint, onto a wall.

In a diaphragm pump of the type described, there are provided a pump chamber into or out of which a pressure fluid is fed, on one side of a diaphragm and a pressure fluid chamber, into or out of which a pressure fluid adapted to deflect the diaphragm, such as for instance oil, is fed, with the diaphragm positioned between the pump chamber and the pressure fluid chamber, while there are provided for the pump chamber two check valves adapted to open or close alternately, one of the check valves being connected to the pressure fluid reservoir containing a liquid such as a paint, and the other of the check valves being connected via a discharge pipe to a spray gun. In addition, the pressure fluid chamber communicates with a cylinder, in which a plunger reciprocates. The plunger is moved back and forth by means of a cam or the like so as to raise or lower the fluid pressure in the pressure fluid chamber, thereby deflecting the aforesaid diaphragm so as to expand or contract the volume of the pump chamber alternately. At the time of expansion, the paint or the like is drawn by suction through one of the check valves, and at the time of contraction, the paint is supplied via the other check valve to a spray gun or the like.

A relief valve is provided between the pressure fluid chamber or cylinder and the pressure fluid reservoir, thereby preventing an excessive pressure rise in the pressure fluid chamber. For instance, in case a nozzle of the spray gun is closed, the load acting on the pump chamber is increased, so that the diaphragm can no longer be operated or deflected, so the pressure of the fluid in the pressure fluid chamber becomes too high during a compression stroke, in which the plunger is moved towards the diaphragm. However, at this time the pressure fluid is bled via the relief valve into the pressure fluid reservoir, thus ensuring safety of the diaphragm pump. For instance, when the nozzle of a spray gun is opened, with the relief valve being set to a high pressure level, then the pump chamber starts delivering the paint under pressure, while the diaphragm is repeatedly deflected to a large extent proportional to the progress the plunger stroke through the medium of a pressure fluid, in response to the back and forth displacements of the plunger. However, it is rare that the fluid pressure in the pressure fluid chamber exceeds the adjusted pressure level for the relief valve, so that little or no fluid is bled through the relief valve.

However, if the relief valve is set to a relatively low pressure level, then the pressure of the fluid in the pressure fluid chamber necessarily exceeds the adjusted pressure level for the relief valve, in the course of the pressurizing stroke of the plunger, after which the pressure fluid is continuously bled into the pressure fluid reservoir via the relief valve, until the termination of the pressurizing storke. Accordingly, in this case, during the pressure reducing stroke following the pressurizing stroke or during the time from the pressure reducing stroke to the beginning phase of the subsequent pressurizing stroke, an amount of pressure fluid corresponding to the amount of pressure fluid which has been discharged from the cylinder and pressure fluid chamber during the pressurizing stroke should be supplied from the pressure fluid pump to the cylinder and pressure fluid chamber.

To this end, a passage for supplying the pressure fluid is provided between the pressure fluid reservoir and the cylinder or the pressure fluid chamber. However, if the internal pressure is a vacuum, the pressure fluid flows at a high speed through the aforesaid passage, so that the pressure fluid is agitated vigorously, thereby producing heat due to internal friction. The temperature rise stemming from the heat of the pressure fluid reduces the allowable operating speed of the pump, thus leading to deterioration of the pressure fluid. Many attempts to solve this shortcoming have been proposed.

For instance, U.S. Pat. No. 3,254,845 (this will be referred to as the Schloser patent, hereinafter) is intended to prevent a temperature rise by utilizing a cooling effect resulting from a cavitation phenomenon. More particularly, in the suction stroke, when the vacuum in the pressure fluid chamber reaches a given set value below the saturated vapor pressure of the pressure fluid, a fluid regulating valve of a lead type, which is provided in the front of a piston, is opened, so that the pressure fluid flows from the reservoir into the pressure fluid chamber via a passage in the piston and the pressure regulating valve, thereby preventing excessive reduction of the vacuum in the chamber. The pressure regulating valve is opened only during the period of time that a vacuum in the pressure fluid chamber remains below the saturated vapor pressure of the pressure fluid, so that the pressure fluid is continuously vaporized during the pressure reducing stroke, and the pressure fluid goes into vapor form, thereby resulting in the so-called cavitation phenomenon. However, cavitation is responsible for the premature corrosion of cylinders and pistons, and hence is not desirable. It is an object of the diaphragm pump according to the present invention to dispense with any auxiliary cooling means or heat exchanger which have otherwise been required for the prior art pumps of this type, by purposely utilizing the cooling effect stemming from the cavitation phenomenon.

U.S. Pat. No. 3,680,981 (this will be referred to as the Wagner patent, hereinafter) is intended to avoid the premature corrosion of the pump wall due to cavitation caused by the pressure fluid, by agitating the pressure fluid so as to increase the air content of the pressure fluid, thereby preventing the reduction of the internal pressure of the cylinder to below the vaporizing pressure of the pressure fluid, by utilizing air emitted from the pressure fluid in the cylinder. The emission of air from the pressure fluid may be considered to be cavitation in a broad sense. However, this provides a cooling effect to some degree, so that there results no marked damage, as compared with that caused by the cavitation of a pressure fluid. The Wagner patent is directed to avoiding a temperature rise by utilizing the aforesaid cavitation defined in a broad sense, in a range such that the pressure fluid does not cause the cavitation. Accordingly, lower the internal pressure in a cylinder during a pressure-reducing stroke of the plunger, the more preferable, insofar as the pressure fluid does not cause cavitation. For this reason, according to the Wagner patent, an opening on the side of cylinder, to a pressure-fluid-supply or replenishing passage is positioned at the extremity of the pressure reducing stroke of the plunger. However, the supplying of pressure fluid should be accomplished within an extremely short time, while the pump is continued to be operated, irrespective of whether the aforesaid supply is sufficient or not, because the time of the passage remains open is controlled mechanically. In case the amount of the pressure fluid supplied is not sufficient, and the amplitude of the diaphragm moment is reduced, so that the supply of pressure fluid becomes insufficient and unstable.

BRIEF SUMMARY OF THE INVENTION

It is accordingly an object of the present invention to provide a diaphragm pump which will avoid the shortcomings in the pumps disclosed in the aforesaid two U.S. patents, by maintaining the internal pressure in the cylinder as low as possible, so that flow of the pressure fluid does not cause cavitation, without resorting to special means for causing air to be contained in the pressure fluid in an amount greater than that of which is normally contained, thereby allowing the relatively long period of time for the supply of a pressure fluid.

According to the present invention, there is provided a diaphragm pump, which includes a pressure fluid supply passage, and a valve adapted to open before the pressure in the pressure fluid chamber is lowered to a level such that separation of air dissolved in the pressure fluid becomes vigorous, and to close when the pressure in the pressure fluid chamber is restored to a level such that the air thus separated is dissolved in the pressure fluid again.

The timing of the opening and closing of the aforenoted valve is set, depending on the position of the plunger and the internal pressure in the cylinder, with respect to a reference condition, so that the valve will be opened or closed in cooperation with the position of the plunger at suitable times. Alternatively the valve can be provided with means for detecting when the internal pressure in the cylinder has reached a level suitable for opening and closing the valve, so that the valve will be opened or closed in response to the pressure thus sensed.

In this manner, according to the diaphragm pump of the invention, pressure fluid can be supplied via a valve adapted to be opened or closed at suitable times in response to a change in the internal pressure in the cylinder, so that cavitation of the pressure fluid does not occur, even if there is provided no means for causing air to be contained in the pressure fluid, and in addition, since the pressure fluid is supplied or replenished over a relatively long period of time, there is no danger of heat generation due to vigorous agitation.

DETAILED DESCRIPTION OF PREFERRED EMBODIMENTS

Figure 1:
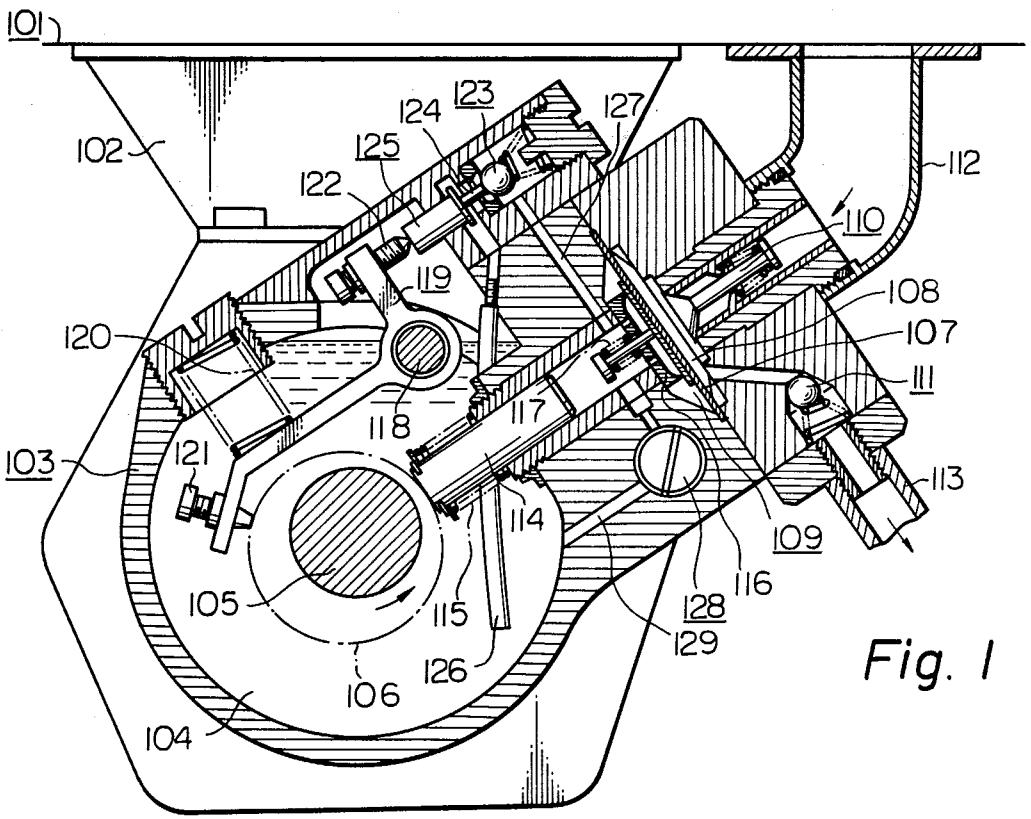
FIG. 1 is a cross-sectional view of the first embodiment of a diaphragm pump according to the present invention.

The first embodiment of the invention will be described in more detail with reference to FIGS. 1 and 2.

A pressure fluid reservoir 104 is defined by a cavity provided in a pump casing 103 the mounting part 102 of which is attached to a seat surface 101 of a support. Provided in the center of the pressure fluid reservoir 104 is a rotary shaft 105 adapted to be driven by power means external of the apparatus, while a bearing cam 106 is secured on the rotary shaft 105 in an eccentric fashion.

Meanwhile, sandwiched between the righthand upper portion of the pump casing 103 and another member having a considerable thickness is a peripheral portion of a diaphragm 107 which partitions the interior of the casing 103 into a pump chamber 108 on the inner side and a pressure fluid chamber 109 on the outer side thereof, respectively.

A suction pipe 112 and a discharge pipe 113 are connected to the pump chamber 108 via check valves 110 and 111 which effect alternating opening and closing operations.

A plunger 114 which is slidably fitted in a cylinder in a large-thickness-portion of the pump casing 103 extends into the pressure fluid chamber 109, with the outer end surface of the plunger 114 being urged by a coil spring 115 provided around the outside of the plunger against the outer peripheral surface of the cam 106. Provided in the pressure fluid chamber 109 is a stop 116 having holes therein, so that the extent of deflection or movement of the diaphragm 107 is limited by the stop 116, and the stop 116 supports one end of a coil spring 117 the other end of which engages a pin connected to the diaphragm so as to load the diaphragm 107 inwards of the pressure fluid chamber.

A shaft 118 is provided above the rotary shaft 105, and an 'L' shaped lever 119 is pivotally mounted on the shaft 118. Secured to one end of the lever 119 is an adjusting screw 121 which is adapted to be urged by a coil spring 120 acting on the lever 119 so as to abut the outer peripheral surface of the cam 106, and another adjusting screw 122 is secured to the other end of the lever 119. Provided in abutment with the tip of the adjusting screw 122 is a valve operating member 125 having a projecting portion 124 adapted to press against and open a check valve 123. One port of the check valve 123 communicates with the pressure fluid reservoir 104 by means of a hose 126, while the other port of the check valve 123 communicates with the pressure fluid chamber 109 via a bore 127. In this arrangement, the adjusting screw 121 is placed at an angular position of about 135° relative to the center axis of the plunger 114, the aforenoted angular position being defined with respect to the center of the rotary shaft 105.

Figure 2:
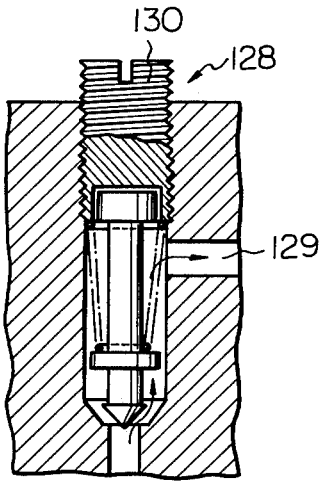
FIG. 2 is a cross-sectional view of a pressure regulating valve for use therein.

In addition, the pressure fluid chamber 109 communicates with the pressure fluid reservoir 104 via a pressure regulating valve 128 as shown in FIG. 2. Shown at 129 is a bore which communicates with the pressure fluid reservoir, and at 130 is an adjusting screw for use in setting the pressure.

The operation of the first embodiment will be described with reference to FIG. 3. The curve shown by a solid line represents the displacement of the plunger 114, while a curve shown by the one-dot chain line represents the displacement of the adjusting screw 121. In this respect, the displacement of the adjusting screw 121 is retarded by 135°, as compared with the displacement of the plunger 114. The plunger 114 and adjusting screw 121 assume the positions closest to the rotary shaft 105 at the lowermost points of their respective curves.

Figure 3:
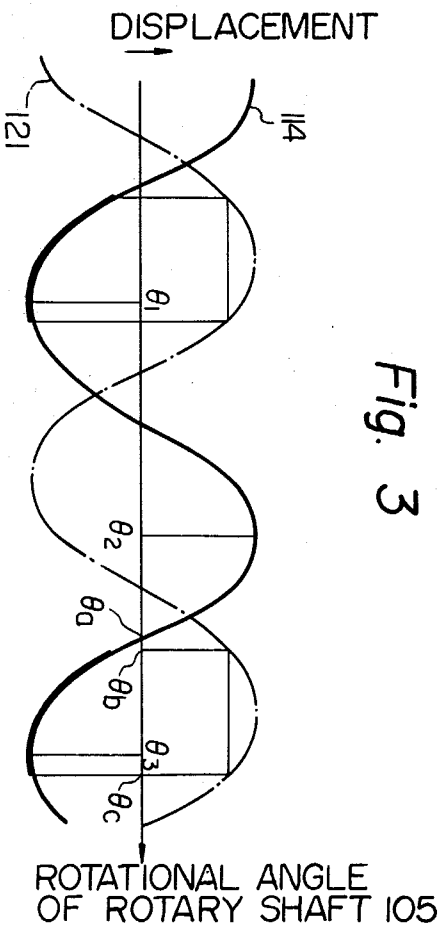
FIG. 3 is a graph illustrative of the operation of the first embodiment.

As shown in FIG. 3, when the rotational angle of the rotary shaft 105 is in the range from $\theta_1$ to $\theta_2$, the plunger 114 is so designed as to move towards the pressure fluid chamber 109, thereby raising the pressure in the fluid chamber 109, and hence deflecting the diaphragm 107 towards the pump chamber 108, thereby reducing the volume of the pump chamber 108, with the pumped result that the fluid is discharged from the pump chamber 108 via check valve 111. Meanwhile, when the pressure of the fluid in the pressure fluid chamber 109 exceeds the set pressure level on the pressure-feeding stroke of the plunger 114, then the pressure fluid is bled via the pressure regulating valve 128 into the pressure fluid reservoir 104.

In FIG. 3, when the rotational angle of the rotary shaft 105 is in a range of from $\theta_2$ to $\theta_3$, the plunger 114 is retracted from the pressure fluid chamber 109, thereby increasing the volume of the pump chamber 108, so that the pumped fluid is drawn by suction via the check valve 110 into the pump chamber 108.

When the rotational angle of the rotary shaft 105 remains is in a range from $\theta_2$ to $\theta_a$ on the suction stroke, the diaphragm 107 is urged by means of the coil spring 117 towards the plunger 114, so that, despite the plunger 114 being in the suction stroke, there is no vacuum in the pressure fluid chamber 109.

When the rotational angle of the rotary shaft 105 is between $\theta_a$ and $\theta_b$, the diaphragm 107 is blocked by means of the stop 116, so that there develops a vacuum in the pressure fluid chamber 109. At this time, the adjusting screw 121 follows the movement of the plunger, which is retarded 135° in phase from the plunger. In addition, when the rotational angle of the rotary shaft is in the range of from $\theta_b$ to $\theta_c$, then the adjusting screw 121 pushes the valve operating member 125 following the movement of the adjusting screw 122, thereby forcibly opening the check valve 123. Thus, in a range of from $\theta_b$ to $\theta_c$, the pressure fluid in the pressure fluid reservoir 104 is introduced under suction into the pressure fluid chamber 109 which is under a vacuum via the hose 126, check valve 123 and the bore 127. Accordingly, the pressure in the pressure fluid chamber 109 is prevented from being lowered to a lever tending to cause cavitation. In addition, the supplying of pressure fluid is suitably timed, so that there is no danger of heat generation due to excessive agitation.

The angle of the plunger 114 relative to the adjusting screw 121 need not necessarily be set at 135°. For instance, a bearing cam can be provided for the plunger 114 and another bearing cam can be provided for the adjusting screw 121 positioned separately from the plunger bearing cam, so that when the angle between the plunger 114 and the adjusting screw 121 is 90°, the aforenoted two cams can be rotationally offset by 45°, thereby obtaining a phase retardation of 135°. Where a cam is provided for the adjusting screw 121 separately of the cam provided for the plunger, the cam for the adjusting screw 121 should not necessarily be a cam having a profile which is a true circle, but can be a cam having an outer peripheral surface, which protrudes at a rotational angle in a range of from $\theta_b$ to $\theta_c$. With such an arrangement, the check valve 123 can be operated in an almost ideal condition. Furthermore, on the suction stroke in this embodiment, the pressure fluid chamber 109 can itself draw the pressure fluid from the pressure fluid reservoir 104. However, as an alternative, the pressure fluid can be forced into the pressure fluid chamber 109 by means of a pump connected to the hose 126, or pressure can be supplied to the pressure fluid reservoir 109 so as to deliver the pressure fluid into the pressure fluid chamber 109. In this case, however, needless to say the thus supplied pressure need not be so high as to deflect the diaphragm against the action of the coil spring 117.

According to the first embodiment of the diaphragm pump of the invention, the pressure fluid reservoir is so designed as to communicate with the pressure fluid chamber via a valve adapted to be forcibly opened when the plunger is retracted from the pressure fluid chamber, so that when the plunger is retracted from the pressure fluid chamber, the vacuum in the pressure fluid chamber will be prevented from being lowered to a level which causes cavitation in the pressure fluid chamber, and in addition, excessive abrupt agitation is prevented, with the resulting freedom from generation of heat, so that high speed operation of the pump can be achieved.

Figure 4:
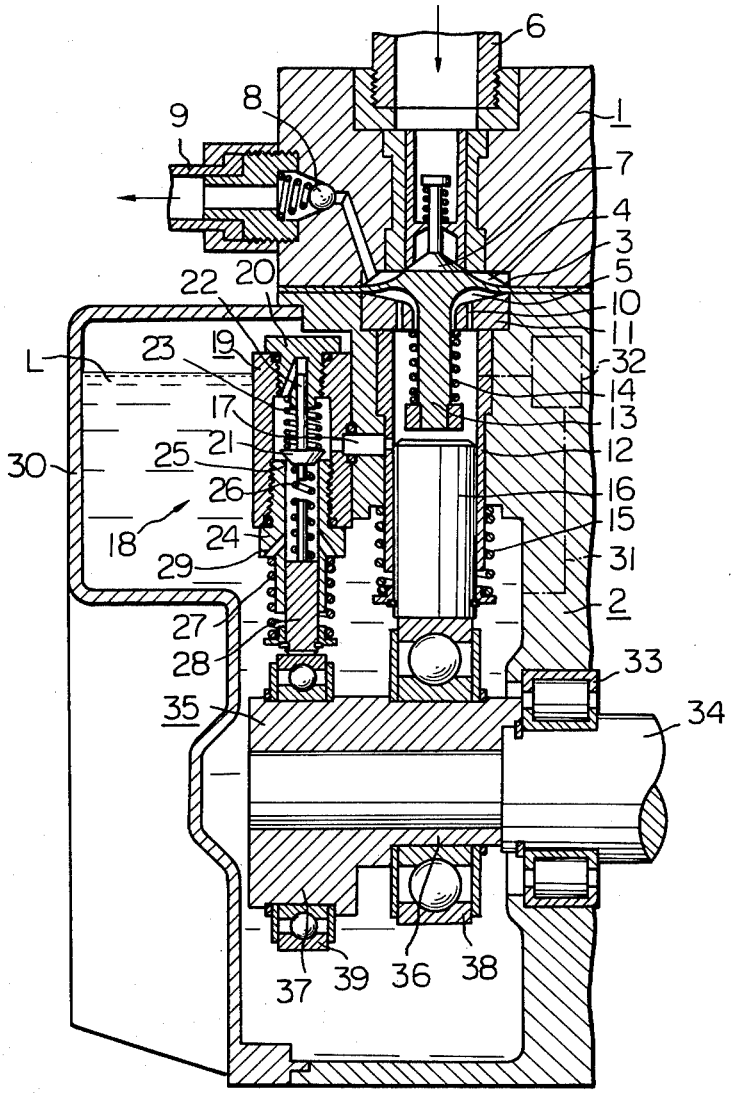
FIG. 4 is a cross-sectional view of the second embodiment of the invention.
Figure 5:
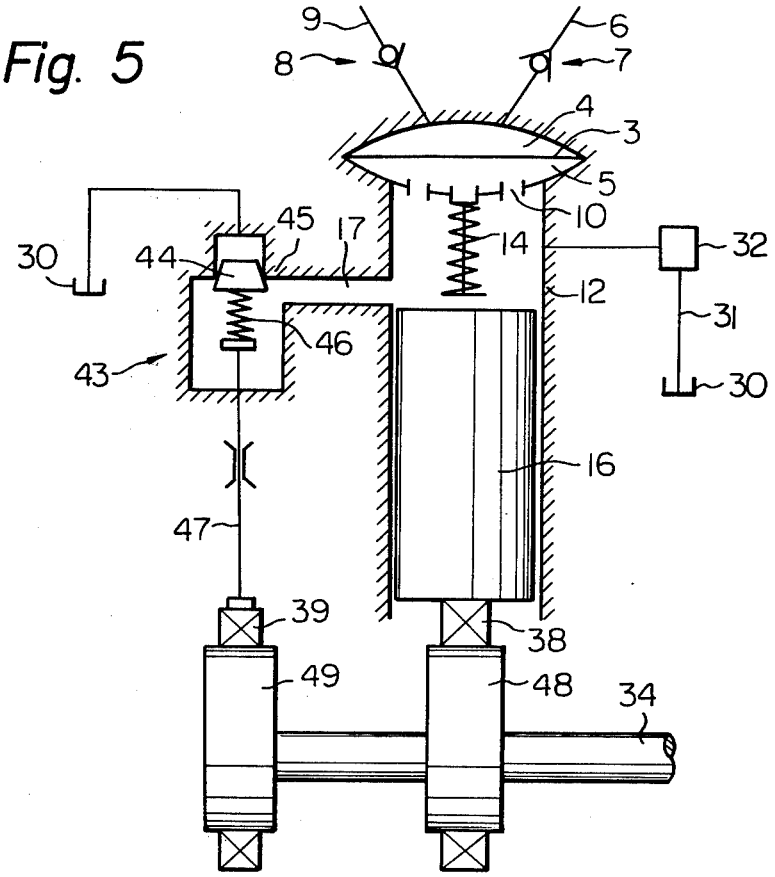
FIG. 5 is a cross-sectional view of the third embodiment of the invention.

The second embodiment shown in FIG. 4 and the third embodiment shown in FIG. 5 are intended to replenish the pressure fluid which has flowed out of the pressure fluid chamber in the diaphragm pump or from a cylinder via a relief valve into the pressure fluid reservoir, thus differing from the first embodiment in that a valve is provided which may be opened or closed in response to a vacuum in the pressure fluid chamber and cylinder.

The aforenoted valve can be a so-called check valve. However, the optimum pressure for opening and closing the valve varies, depending on the positions of the plunger, so that in these embodiments, the force of a spring to load the valve body in the check valve so as to move the valve body towards a valve seat is so designed as to vary synchronously with the movement of the plunger adapted to drive the pressure fluid. In other words, when the plunger is retracted, and the pressures of fluids in the pressure fluid chamber and cylinder remain low, then the force of a compression spring adapted to load the valve body against the valve seat is weakened, so as to effectively prevent cavitation of the pressure fluid, thereby allowing the opening of the valve body with ease. In addition, when the spray gun or the like connected to the pump chamber is operated so as to drive the pump, then the valve is subjected to the pressure of the pressure fluid so as to determine whether or not the timing to supply the pressure fluid is proper, thereby forcibly converting a displacement of a rod into a force for loading the spring, thereby enabling the positive opening and closing of the valve, which can not otherwise be achieved by a plain check valve, by utilizing the difference between the vacuum in the cylinder and the positive external pressure or atmospheric pressure, whereby the cavitation and supply of a pressure fluid can be positively achieved by converting the displacement of a rod into a force adapted to load a spring, commensurate with a vacuum mode created due to the retracting motion of a plunger, when a spray gun is operated.

The arrangement and operation of the second embodiment will be described with reference to FIG. 4.

The diaphragm 3 is placed between the opposed cavities provided in an upper housing member 1 and a lower housing member 2, respectively, and a peripheral portion of the diaphragm 3 is sandwiched between the upper and lower housing members 1 and 2. A cavity above the diaphragm 3 serves as a pump chamber 4, while a cavity under the diaphragm 3 serves as a pressure fluid chamber 5.

A pumped fluid such as a paint is introduced under suction through a suction pipe 6 connected to the upper housing member 1 via a poppet type check valve 7 into the pump chamber 4, and the pumped fluid is delivered from the pump chamber 4, via a ball type check valve 8, into a discharge pipe 9. Connected to the discharge pipe 9 is a spray gun or the like for use in spraying paint onto a wall.

A spring seat 11 having holes 10 therein is provided for the pressure fluid chamber 5 with the holes 10 being in communication with the interior of a cylinder 12 mounted in the lower housing member 2. A spring mounting portion 13 integral with the diaphragm 3 is positioned in the upper portion of the cylinder 12, and the diaphragm 3 is loaded so as to be deflected downwards by means of a return spring 14 which is a compression spring mounted on the spring mounting portion 13. A plunger 16 is slidably fitted in the lower portion of the cylinder 12, while being so loaded as to be moved downwards by a compression spring 15.

A lateral hole 17 is provided in the lower housing 2 in a position hole 17 is not closed by the plunger 16 even when the plunger 16 is in the uppermost position, and a poppet type check valve 18 is connected to the hole 17 for controlling the supply of pressure fluid through the hole 17.

The poppet type check valve 18 is constituted by an adjusting screw 20 threaded into the upper portion of a valve casing 19 in liquid tight relation, and a stem portion 22 of a valve body 21 is movably retained in a bore in the adjusting screw 20, and a compression spring 25 between the screw 20 and the valve body 21 urges the valve body 21 downwards. The compression of spring 23 can be adjusted by screw 20. In addition, an upper portion of a member 24 is threaded into a lower portion of the valve casing 19 in a liquid-tight relation, with the top end of the member 24 being used as a valve seat 25 for the valve body 21. Furthermore, a compression coil spring 26 abuts the undersurface of the valve body 21 and is mounted internally of the member 24, and a rod 28 slidable in the lower part of member 24 is engaged by the spring 26 is urged downwards under the action of a compression spring 27 between the rod 28 and the lower portion of the body 24. A hole 29 extends through the body 24 to the hollow which holds the compression spring 26 and places it in communication with the reservoir 30. The compression spring 26 and rod 28 act as means for varying the force of the compression spring 23 acting on the valve body 21, in synchronism with the back and forth motions of the plunger 16 in a manner to be described hereinafter.

The hole 29 in the poppet type check valve 18, the hollow which holds the compression coil spring 26, the hollow which holds the compression coil spring 23, and the hole 17 constitute a passage adapted to supply or replenish a pressure fluid (L) from the pressure fluid reservoir 30 via the cylinder 12 to the pressure fluid chamber 5.

On the other hand, in addition to the aforenoted supply passage, a passage 31 is provided, which leads from the upper portion of the cylinder 12 to the pressure fluid reservoir 30, and a relief valve 32 is provided in the passage 31, thereby preventing an excessive rise or buildup of fluid pressure in the pressure fluid chamber 5.

A drive shaft 34 is mounted in a liquid-tight relation in the lower portion of the lower housing member 2 in a bearing 33, and an eccentric circular cam member 35 is mounted a portion of the drive shaft 34 which is located internally of the reservoir. The cam member 35 includes two eccentric circular cams 36 and, 37 at a phase difference of 180°, as shown in FIG. 3. The cam 36 is positioned in opposed relation to the plunger 16, and a bearing 38 is mounted on the outer periphery of the cam 36 abutting the undersurface of the plunger 16. The other cam 37 is provided in a position opposed to the rod 28 and compresses the spring 27, and a bearing 39 is mounted on the outer periphery of the cam 37 so as to abut the undersurface of the rod 28.

The operation of the second embodiment will now be described.

When the drive shaft is rotated, the eccentric circular cams 36 and 37 cause the plunger 16 and rod 28 to move back and forth with a phase difference of 180° and in synchronous relation. As a result, when the plunger 16 is retracted downwards, then rod 28 is pushed upwards so as to compress the compression coil spring 26, thereby reducing the force with which the valve body 21 is seated on the valve seat 25 under the action of the spring 23. On the other hand, when the plunger 16 moves upwards into the pressure fluid chamber 5, the rod 28 adapted to load the spring is lowered under the action of the compression coil spring 27, so that the force of the compression coil spring 26 is reduced, so the valve body 21 is strongly urged against the valve seat 25 under the action of the compression spring 23.

In this operational condition, for instance, when a spray gun (not shown) connected to the discharge pipe 9 is opened for accomplishing the spraying of paint, the pressure of the pumped fluid in the pump chamber 4 is increased or decreased in response to the deflection of the diaphragm corresponding to the back and forth movements of the plunger 16, whereupon the pressure fluid in the pressure fluid chamber 5 is forced into or out of the cylinder 12 via the holes 10, so that there is no danger of the pressure fluid flowing via the relief valve 32 into the pressure fluid reservoir 30. In addition, when the spray gun is maintained in operation, and the plunger 16 is retracted downwards, the diaphragm 3 is forcibly returned downwards under the load of return spring 16, so that a positive pressure is maintained in the cylinder 12. Accordingly, the positive pressure thus maintained acts on the top surface of the valve body 21 of the poppet type check valve 18, with the result that the force opposing the compression coil spring 26 is increased during the retracting motion of the plunger 16. As a result, even if the force of the compression coil spring 26 is increased so as to reduce the force by which the valve body is urged against the valve seat, the valve body 21 will not open under the aforenoted positive pressure. This condition will be maintained until energy stored in the return spring 14 is exhausted due to the retracting motion of the plunger, which will destroy the balance between the force of the compression coil spring 26 and the energy thus stored. Even if the relief valve 32 is moved to an almost closed condition, the pressure fluid lost through leakage between the plunger 16 and the cylinder 12 will be supplied or replenished so that the check valve 18 is opened only when the plunger 16 reaches the fully retracted position.

On the other hand, if the spray gun is stopped, the pumped fluid remains in the pump chamber 4, and hence the diaphragm 3 is not deflected, despite the fact that the plunger 16 reaches its advanced position, so that the pressure of the fluid is increased excessively in the pressure fluid chamber 5 as well as in the cylinder 12, each time the plunger 16 is displaced towards the pressure fluid chamber 5, with the result that part of the pressure fluid is bled via the relief valve 32 into the pressure fluid reservoir 30.

For this reason, when the plunger 16 is being retracted, even if the diaphragm 3 is forcibly deflected downwards by means of the return spring 14, a vacuum exists in the pressure fluid chamber 5 and cylinder 12. Accordingly, the vacuum acts on the top surface of the valve body 21 in the aforenoted poppet type check valve 18 through the hole 17, whereupon the valve body 21 is separated from the valve seat 25 due to the increased force of the compression coil spring 26 in response to the retracting motion of the plunger 16, so that the pressure fluid is drawn by suction from the pressure fluid reservoir 30 via the check valve 18 into the cylinder 12. The cavitation which is detrimental to the pressure fluid can be positively prevented, commensurate with the vacuum mode resulting from the retracting motion of the plunger 16.

Figure 6:
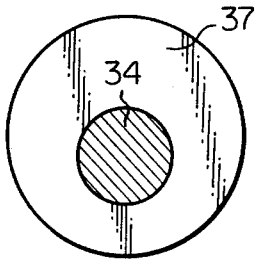
FIGS. 6 and 7 are views of modifications of cams adapted to extend and retract a rod for loading springs in respective valves.
Figure 7:
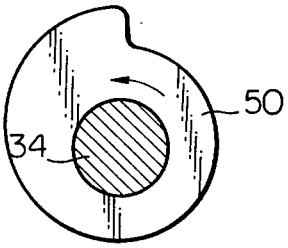

In this embodiment, the eccentric circular cam 37 as shown in FIG. 6 is used as a cam for moving the rod for loading a spring. However, as an alternative, a cam 50 having a shape as shown in FIG. 7 may be used therefor. In other words, immediately after the compression coil spring 26 is compressed to its full extent, the spring is extended, thereby weakening the force urging the valve body 21 upwards instantaneously, so that the force urging the valve body 21 urged against the valve seat 25 is instantaneously incrased, thereby providing for a quick compression stroke of the plunger 16.

In the third embodiment shown in FIG. 5, there is provided a poppet type check valve 43 which is different from that of the poppet type check valve 18. A rod 47 is in direct abutment with the lower end of a compression coil spring 46 adapted to urge the valve body 44 against the valve seat 45 which rod 47 is adapted to load the spring so as to vary the force of the spring 46 in synchronism with the back and forth motions of the plunger 16. The rod 47 is moved in the same direction as that of the plunger 16. Stated differently, the cam 48 for the plunger and the cam 49 for the rod 47 are eccentric in the same direction in this embodiment. Like the second embodiment, when the plunger 16 is displaced upwards, the force of the compression coil spring 46 is increased. Upon the downward displacement of the plunger, the force of the spring 46 is weakened. The function or operation of the pump is the same as that of the second embodiment, so a detailed description thereof is omitted.

According to the second and third embodiments, when pressure is restored by replacing fluid lost by leaking from the pressure fluid chamber in the diaphragm pump, or from the cylinder via a relief valve or between the plunger and the cylinder, when the plunger is retracted and the pressure of a pressure fluid in the pressure fluid chamber and cylinder is reduced, the force urging a valve body in a check valve which is positioned in a passage adapted to supply pressure fluid for replenishment is reduced in response to a vacuum resulting from the retracting motion of the plunger, thereby allowing easy opening of the valve body to prevent the detrimental cavitation. In addition, when the spray gun is operated so as to effect the full driving of a pump, with the pressure of the fluid in the pressure fluid chamber and cylinder is raised, resulting in easy detaching of the valve body from the valve seat, then the cooperative well-balanced motions among the diaphragm, pressure fluid and plunger are lost. To cope with this, the positive pressures stored in the diaphragm and return spring are released so as to act on the check valve adapted to supply the pressure fluid, thereby positively destroying the balance between the aforenoted positive pressure and the force required to open the check valve at the fully retracted position of the plunger, while supplying pressure fluid so as to replenish the small amount of fluid lost by leaking between the plunger and the cylinder. In addition, when the plunger is advanced towards the pressure fluid chamber and hence the pressure of the fluid in the pressure fluid chamber and the like is high, the force on the valve body necessary to close the check valve adapted to replenish the pressure fluid is increased, so as to cause the valve body to be seated against the valve seat tightly.

The diaphragm pump according to the present invention reconciles the conflicting two objects of an optimum supply of a pressure fluid, which is free of heat generation, and cavitation of the pressure fluid.

What is claimed is:

1. A diaphragm pump comprising a diaphragm and having a pump chamber on one side of said diaphragm and a pressure fluid chamber on the other and a cylinder communicating with said pressure fluid chamber, a plunger reciprocally movable in said cylinder for raising and lowering the pressure of a pressure fluid in said pressure fluid chamber for deflecting said diaphragm in response to an increase or decrease in said pressure and causing said diaphragm to effect a pumping action on a pumped fluid in said pump chamber; driving means connected to said plunger for reciprocating said plunger; a pressure fluid reservoir; first means communicating the space within said cylinder and said pressure fluid chamber with said reservoir and having a pressure regulating valve for opening only when the pressure of the pressure fluid in said cylinder and said response fluid chamber exceeds a predetermined value during a pressurizing stroke of said plunger; further means communicating said space within said cylinder and said pressure fluid chamber with said reservoir and having a further valve therein; and a cam means driven by said driving means and acting on said further valve in coordination with the reciprocating motion of said plunger, said cam means having a shape for opening said further valve during a pressure reducing stroke of said plunger before the pressure of the pressure fluid in said cylinder and said pressure fluid chamber is lowered to a level at which the separation of air dissolved in said pressure fluid becomes vigorous, and closing said further valve during a pressurizing stroke of said plunger when the pressure of the pressure fluid in said pressure fluid chamber and cylinder is restored to a level at which the air begins dissolving into said pressure fluid again.

2. A diaphragm pump comprising a diaphragm and having a pump chamber on one side of said diaphragm and a pressure fluid chamber on the other and a cylinder communicating with said pressure fluid chamber, a plunger reciprocally movable in said cylinder for raising and lowering the pressure of a pressure fluid in said pressure fluid chamber for deflecting said diaphragm in response to an increase or decrease in said pressure and causing said diaphragm to effect a pumping action on a pumped fluid in said pump chamber; driving means connected to said plunger for reciprocating said plunger; a pressure fluid reservoir; first means communicating the space within said cylinder and said pressure fluid chamber with said reservoir and having a pressure regulating valve for opening only when the pressure of the pressure fluid in said cylinder and said pressure fluid chamber exceeds a predetermined value during a pressurizing stroke of said plunger; further means communicating said space within said cylinder and said pressure fluid chamber with said reservoir and having a check valve means therein for opening or closing in response to the difference between the pressure of pressure fluid in said pressure fluid reservoir and the pressure of pressure fluid in said pressure fluid chamber and cylinder, said check valve means opening during a pressure reducing stroke of said plunger before the pressure of the pressure fluid in said cylinder and said pressure fluid chamber is lowered to a level at which the separation of air dissolved in said pressure fluid becomes vigorous, and closing during a pressurizing stroke of said plunger when the pressure of the pressure fluid in said pressure fluid chamber and cylinder is restored to a level at which the air begins dissolving into said pressure fluid again.

3. A diaphragm pump as claimed in claim 2 wherein said check valve means comprises means acted on by said driving means for varying in coordination with the reciprocating motion of said plunger the pressure at which said check valve means opens and closes.

4. A diaphragm pump as claimed in claim 3 wherein said check valve means has a valve body and a valve seat, and said means for varying the pressure at which said check valve means opens and closes includes a compression coil spring engaging said valve body and urging it against said valve seat, and a cam driven by said driving means and acting on said check valve means for varying the force of said coil spring in coordination with the movement of said plunger.

* * * * *